US007263200B2

(12) United States Patent
Chang et al.

(10) Patent No.: US 7,263,200 B2
(45) Date of Patent: Aug. 28, 2007

(54) LOUD SPEAKER

(75) Inventors: Jui-Cheng Chang, Taichung (TW); Yu-Shen Yeh, Taichung (TW)

(73) Assignee: Merry Electronics Co., Ltd, Taichung (TW)

( * ) Notice: Subject to any disclaimer, the term of this patent is extended or adjusted under 35 U.S.C. 154(b) by 220 days.

(21) Appl. No.: 10/907,302

(22) Filed: Mar. 28, 2005

(65) Prior Publication Data

US 2006/0215869 A1 Sep. 28, 2006

(51) Int. Cl.
*H04R 25/00* (2006.01)

(52) U.S. Cl. ..... 381/410; 381/409

(58) Field of Classification Search ..... 381/394–396, 381/400, 401, 409, 410, 417, 386; 439/493, 439/86; 29/594, 609.1; 379/431, 433.02, 379/433.05, 432

See application file for complete search history.

(56) References Cited

U.S. PATENT DOCUMENTS 6,389,148 B1 * 5/2002 Yoo et al. ..... 381/417
7,010,142 B2 * 3/2006 Kuwabara et al. ..... 381/409

* cited by examiner

*Primary Examiner*—Huyen Le
(74) *Attorney, Agent, or Firm*—Alan Kamrath; Kamrath & Associates PA

(57) ABSTRACT

A loud speaker includes a circuit board and a base. The circuit board includes a plurality of contacts on a side thereof. The base is formed of plastic material by injection molding. The base includes an insertion groove in an end thereof. The circuit board is embedded in the insertion groove. The base further includes a plurality of grooves in communication with the insertion groove. The grooves are respectively aligned with the contacts of the circuit board. The circuit board is placed in a mold for forming the base and the circuit board is embedded in the base after formation of the base by injection molding.

9 Claims, 7 Drawing Sheets

6-6

LOUD SPEAKER

BACKGROUND OF THE INVENTION

1. Field of the Invention

The present invention relates to a loud speaker. In particular, the present invention relates to a loud speaker including a base and a circuit board.

2. Description of the Related Art

FIGS. 1 and 2 of the drawings illustrate a conventional loud speaker comprising a base 1 and a circuit board 2. As illustrated in FIG. 2, the circuit board 2 is bonded to the base 1 by adhesive 3. However, the amount of applied adhesive 3 depends on the workers such that the rate of disqualified products is relatively high while failing to provide a sufficient bonding effect. Further, use of the adhesive 3 is not friendly to the environment.

FIG. 3 illustrates another conventional loud speaker comprising a base 4 and a circuit board 5 that is fixed to the base 4 by at least one screw 6. However, use of the screws 6 requires labor-intensive work, leading to an increase of the cost. Further, the screw 6 increases the overall volume of the circuit board 5, which is detrimental to miniaturization of the product.

Another option for fixing a circuit board to a base of a loud speaker includes the use of hooks. However, the engaging strength is not reliable, and the life of the product is shortened.

SUMMARY OF THE INVENTION

A loud speaker in accordance with the present invention includes a circuit board and a base. The circuit board includes a plurality of contacts on a side thereof. The base is formed of plastic material by injection molding. The base includes an insertion groove in an end thereof. The circuit board is embedded in the insertion groove. The base further includes a plurality of grooves in communication with the insertion groove. The grooves are respectively aligned with the contacts of the circuit board. The circuit board is placed in a mold for forming the base, and the circuit board is embedded in the base after formation of the base by injection molding.

Preferably, the circuit board includes a positioning hole in each of two ends and an intermediate section thereof. Each positioning hole receives excessive plastic material of the base during injection molding of the base.

Preferably, each groove includes a recessed section in a bottom wall delimiting the groove for receiving a wire.

Preferably, the number of the contacts is four, and the number of the grooves is also four.

Preferably, the base includes a receiving compartment in a side thereof. Preferably, the base further includes a tubular section on another side thereof. The tubular section includes a through-hole in communication with the receiving compartment. The tubular section and the receiving compartment accommodate other components of the loud speaker. Preferably, the base further includes a plurality of vents on two sides of the tubular section. The vents are in communication with the receiving compartment. Preferably, the base further includes a notch adjacent to the insertion groove for receiving a coil. Preferably, the base is substantially ellipsoid.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
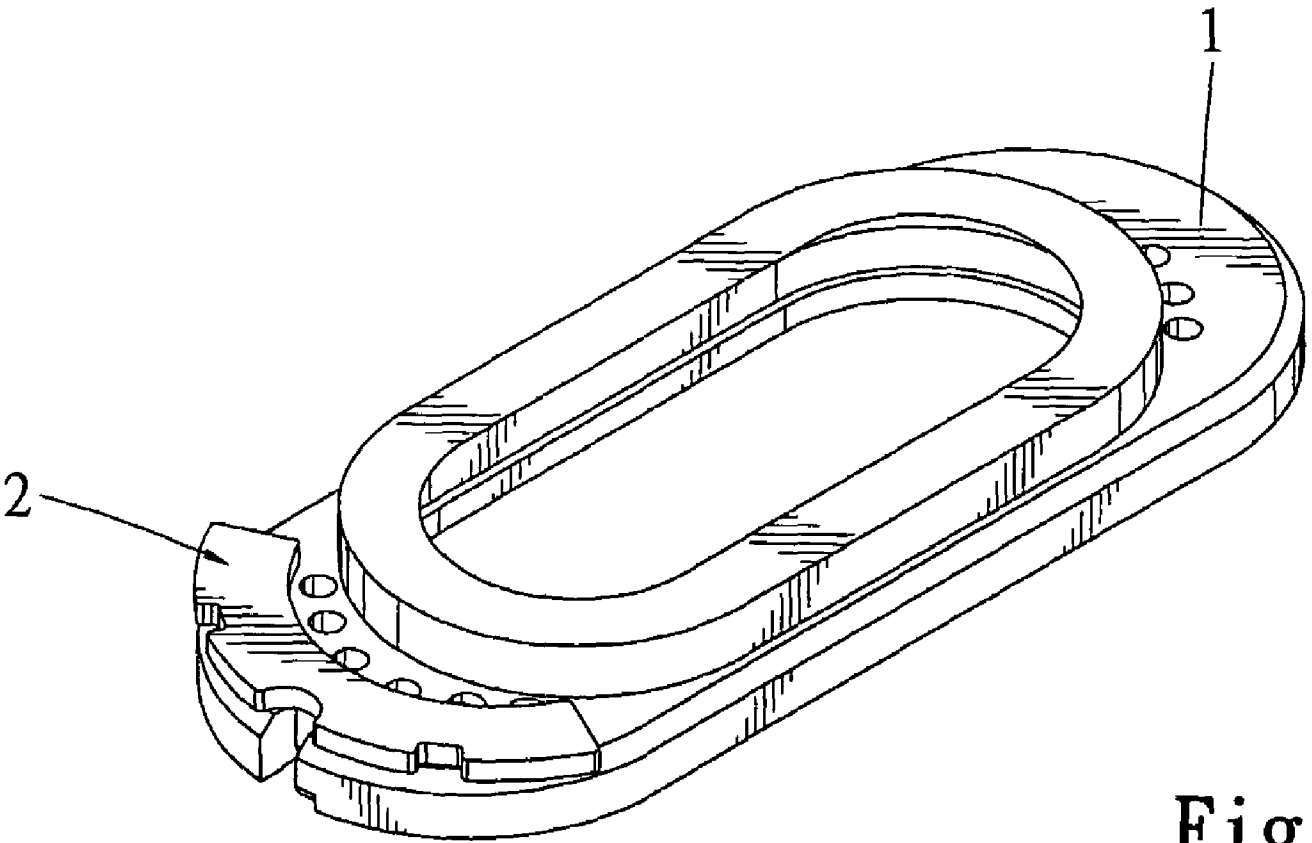
Fig. 1 PRIOR ART
FIG. 1 is a perspective view of a conventional loud speaker.
Figure 2:
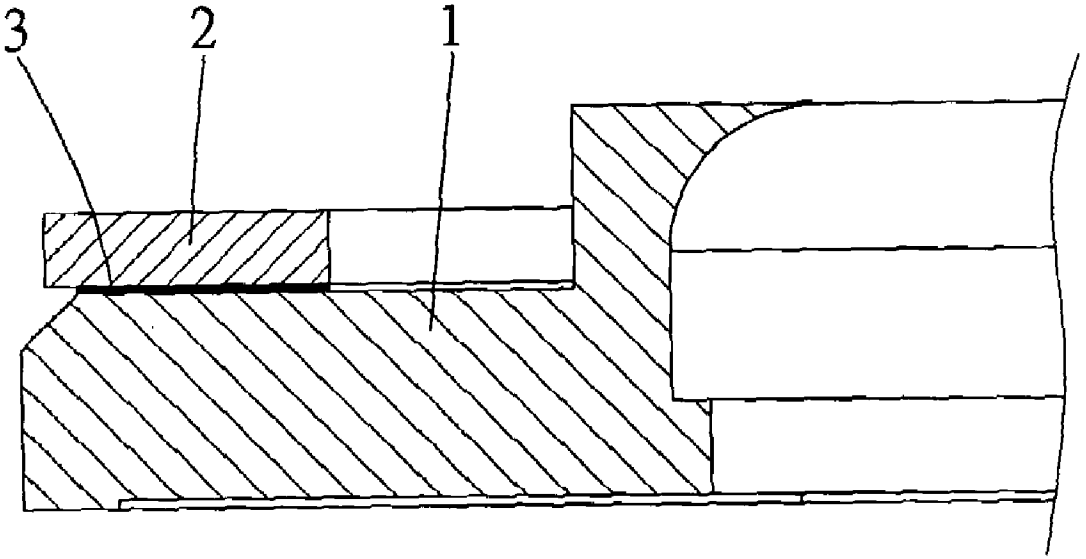
Fig. 2 PRIOR ART
FIG. 2 is a partial sectional view of the conventional loud speaker in FIG. 1.
Figure 3:
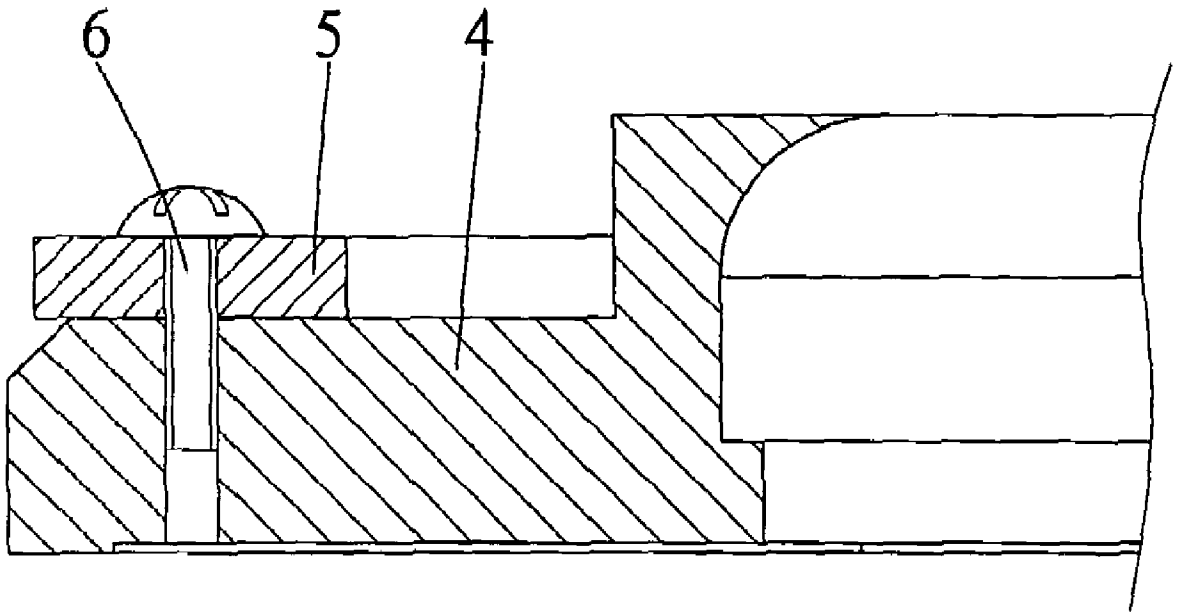
Fig. 3 PRIOR ART
FIG. 3 is a partial sectional view of another conventional loud speaker.
Figure 4:
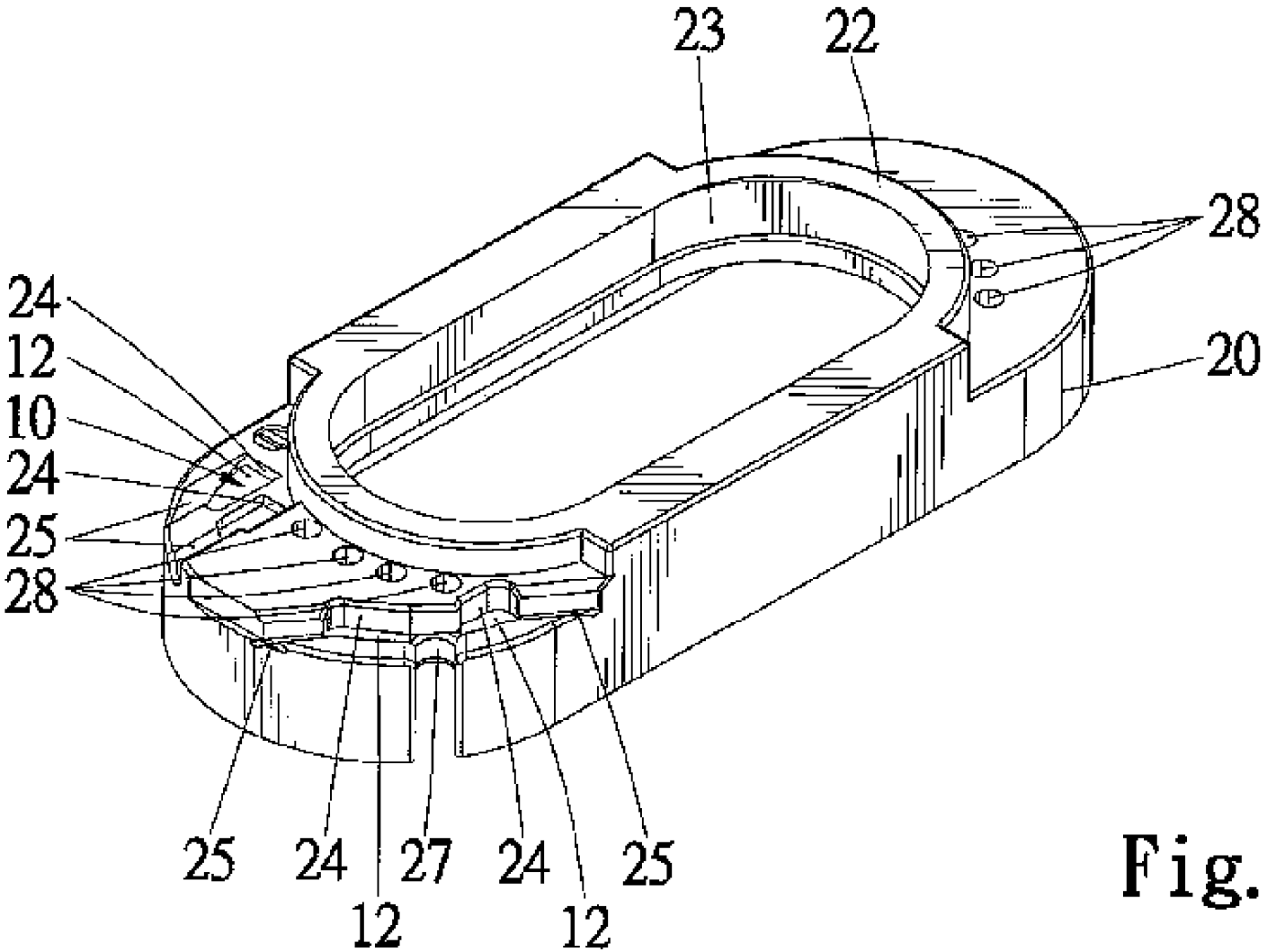
FIG. 4 is a perspective view of a loud speaker in accordance with the present invention.

Referring to FIG. 4, a loud speaker in accordance with the present invention comprises a circuit board 10 and a base 20. The circuit board 10 is integrally formed with and embedded in the base 20, thereby saving the cost, improving the strength, and prolonging the life of the loud speaker.

Figure 5:
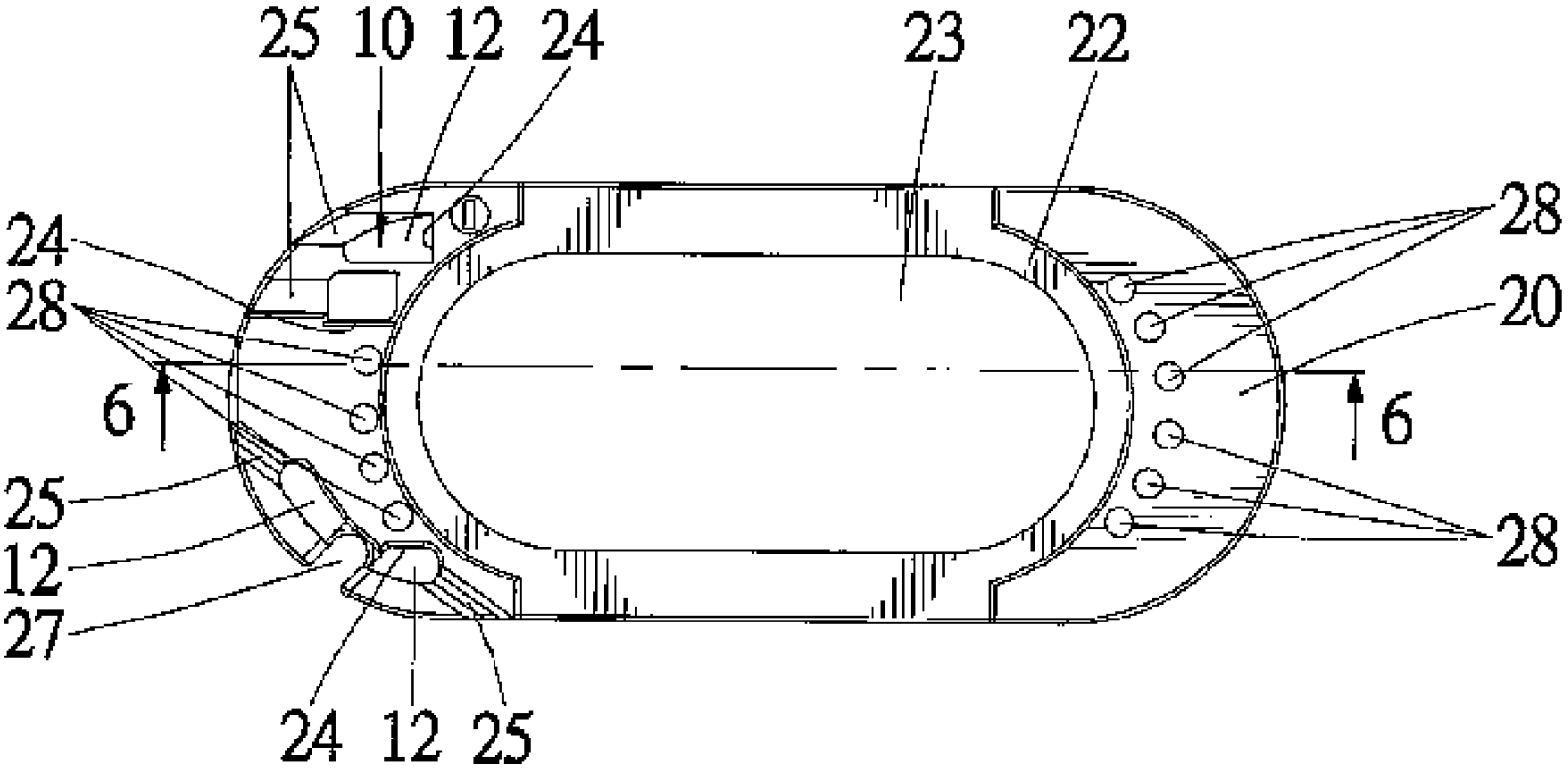
FIG. 5 is a top view of the loud speaker in accordance with the present invention.
Figure 6:
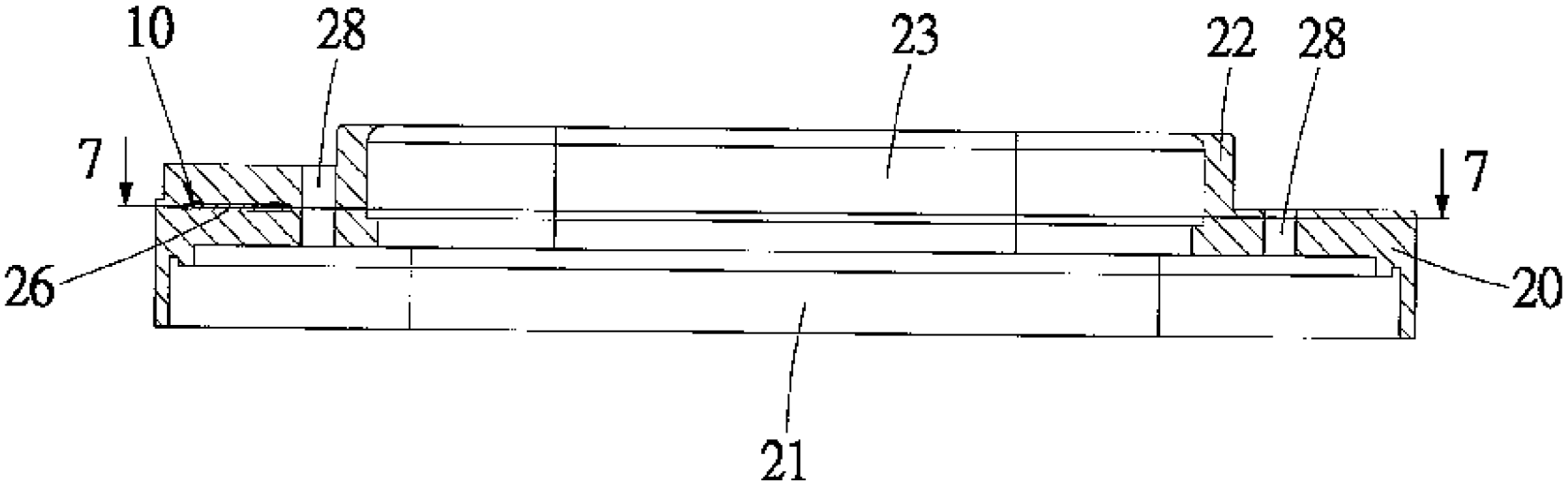
FIG. 6 is a sectional view taken along plane 6-6 in FIG. 5.
Figure 7:
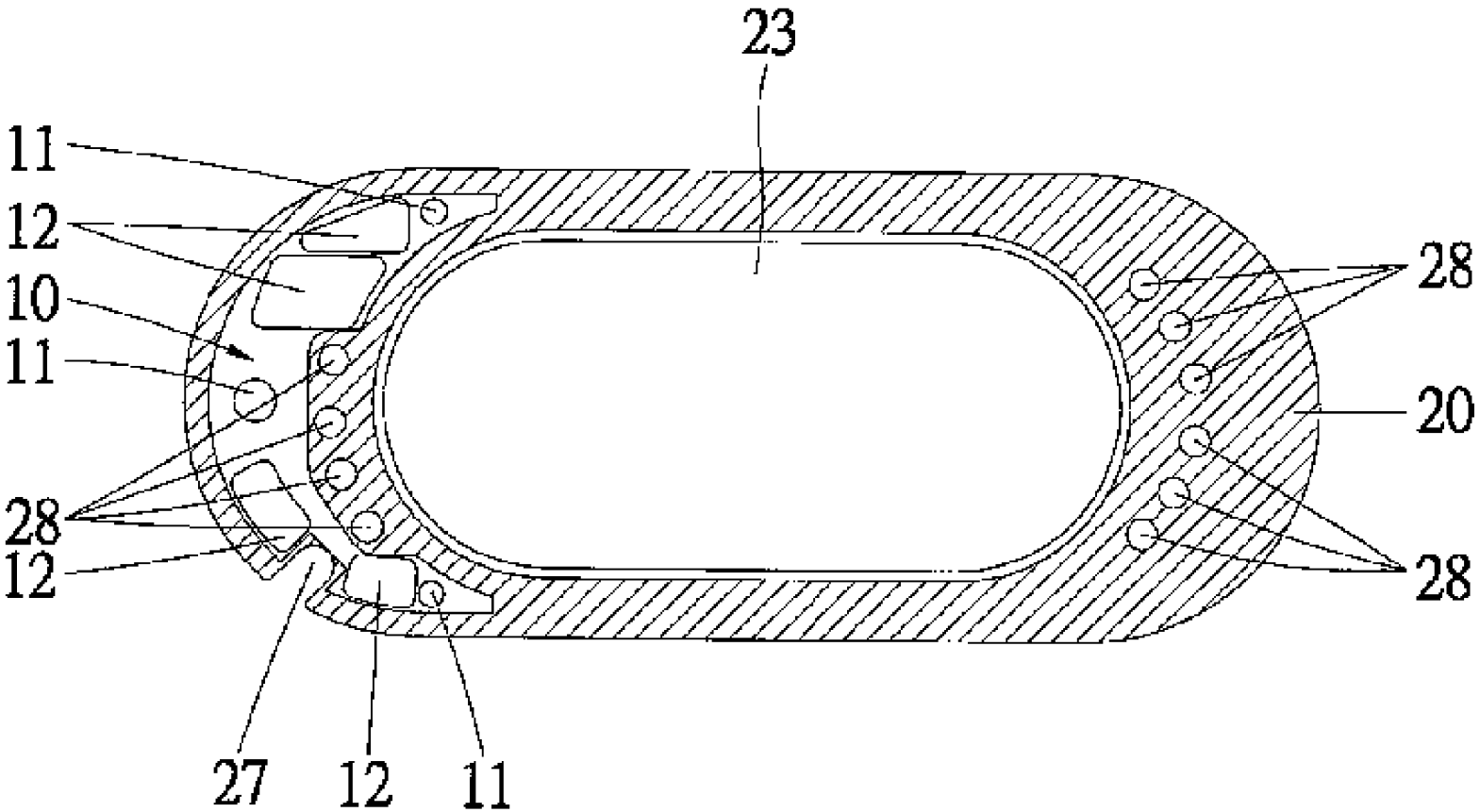
FIG. 7 is a sectional view taken along plane 7-7 in FIG. 6.

Still referring to FIG. 4 and further to FIGS. 5 through 7, the circuit board 10 (such as a printed circuit board) is substantially a crescent board and includes a positioning hole 11 (FIG. 7) in each of two ends and in an intermediate section thereof. Further, a plurality of contacts 12 (four in this embodiment) are provided on the circuit board 10, as illustrated in FIG. 7.

The base 20 is substantially ellipsoid and preferably formed of plastic material by injection molding. The base 20 includes a first side and a second side. Referring to FIG. 6, a receiving compartment 21 is defined in the first side of the base 20. A tubular section 22 extends from the second side of the base 20 and includes a through-hole 23 in communication with the receiving compartment 21. Preferably, the tubular section 22 is substantially ellipsoid when viewed from top. Components of a loud speaker such as a magnet, a coil, a diaphragm, etc., are mounted in the receiving compartment 21 and the through-hole 23, which is conventional and, thus, not described in detail.

A plurality of grooves 24 are defined in an end of the second side of the base 20. Each groove 24 includes a recessed section 25 in a bottom wall delimiting the groove 24 for receiving a wire (not labeled) connected to an associated element. In the illustrated embodiment, the base 20 includes four grooves 24 respectively aligned with the contacts 12 of the circuit board 10. These grooves 24 are in communication with one another via an insertion groove 26 (FIG. 6) in the end of the second side of the base 20. The circuit board 10 is received in the insertion groove 26.

The base 20 further includes a notch 27 adjacent to the insertion groove 26. The notch 27 is used to accommodate a coil (not shown). Further, a plurality of vents 28 are defined on two sides of the tubular section 22. As illustrated in FIG. 6, each vent 28 extends from the second side of the base 20 to the receiving compartment 21 for ventilation purposes.

The circuit board 10 is embedded in the insertion groove 26 of the base 20 by embedding injection. More specifically, the circuit board 10 is placed in a mold for forming the base 20, and the base 20 is then formed by injecting plastic material into the mold. The circuit board 10 is thus securely embedded in the base 20. The positioning holes 11 may receive excessive plastic material for forming the base 20. Thus, the circuit board 10 is securely fixed in the insertion groove 26 of the base 20 after formation of the base 20. The rate of disqualified products is reduced and the manufacturing time is shortened, thereby saving costs.

Provision of the insertion groove 26 in the base 20 avoids use of adhesive and screws for fixing the circuit board 10. In other words, the loud speaker thus manufactured is friendly to the environment. Further, embedding of the circuit board 10 in the base 20 provides improved strength, prolongs the life, and allows miniaturization of the product. The resultant loud speaker can be used with various electronic products and communication equipment such as computers, mobile phones, personal CD players, recording devices, personal digital assistants, digital cameras, electronic dictionaries, multi-media loud speakers, etc.

Although specific embodiments have been illustrated and described, numerous modifications and variations are still possible without departing from the essence of the invention. The scope of the invention is limited by the accompanying claims.

What is claimed is:

1. A loud speaker comprising:

a circuit board including a plurality of contacts on a side and a positioning hole in each of two ends thereof; and a base formed of plastic material by injection molding, the base including an insertion groove in an end thereof, the circuit board being embedded in the insertion groove, the base further including a plurality of grooves in communication with the insertion groove, the grooves being respectively aligned with the contacts of the circuit board;

wherein the circuit board is placed in a mold for forming the base and wherein the circuit board is embedded in the base after formation of the base by injection molding, each said positioning hole receiving excessive plastic material of the base during injection molding of the base.

2. The loud speaker as claimed in claim 1, wherein each said groove includes a recessed section in a bottom wall delimiting the groove, the recessed section being adapted to receive a wire.

3. The loud speaker as claimed in claim 1, wherein the number of the contacts is four and wherein the number of the grooves is four.

4. The loud speaker as claimed in claim 1, wherein the base includes a receiving compartment in a side thereof.

5. The loud speaker as claimed in claim 4, wherein the base further includes a tubular section on another side thereof, the tubular section including a through-hole in communication with the receiving compartment, the tubular section being adapted to accommodate another components of the loud speaker.

6. The loud speaker as claimed in claim 5, wherein the base further includes a plurality of vents on two sides of the tubular section, the vents being in communication with the receiving compartment.

7. The loud speaker as claimed in claim 6, wherein the base further includes a notch adjacent to the insertion groove.

8. The loud speaker as claimed in claim 7, wherein the base is substantially ellipsoid.

9. The loud speaker as claimed in claim 1, wherein a positioning hole is in an intermediate section of the circuit board.

* * * * *